US006523548B2

(12) United States Patent
Bouix et al.

(10) Patent No.: US 6,523,548 B2
(45) Date of Patent: Feb. 25, 2003

(54) POUCH CONTAINER INSERT FOR A COSMETIC PACKAGE AND PACKAGE MADE WITH THE SAME

(75) Inventors: Herve F. Bouix, New York, NY (US); Jonathan Thayer, North Bergen, NJ (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/910,296

(22) Filed: Jul. 20, 2001

(65) Prior Publication Data

US 2003/0015211 A1 Jan. 23, 2003

(51) Int. Cl.[7] ..... A45D 40/26; A45D 40/24; A46B 11/00

(52) U.S. Cl. ..... 132/218; 132/317; 401/122; 401/129

(58) Field of Search ..... 132/218, 317, 132/320; 401/122, 126, 127, 129, 123, 124; 206/581, 229, 230

(56) References Cited

U.S. PATENT DOCUMENTS

| | | | | | |
|---|---|---|---|---|---|
| 4,332,494 | A | * | 6/1982 | Kingsford | 401/122 |
| 4,370,989 | A | | 2/1983 | Taylor | 132/79 B |
| 4,705,053 | A | * | 11/1987 | Goncalves | 132/218 |
| 4,952,204 | A | | 8/1990 | Kortweg | 604/1 |
| 4,982,838 | A | | 1/1991 | Fitjer | 206/209 |
| 5,054,946 | A | | 10/1991 | Morel | 401/122 |
| 5,349,972 | A | * | 9/1994 | Dirksing et al. | 132/218 |
| 5,862,818 | A | | 1/1999 | Marinelli | 132/312 |
| 6,142,692 | A | * | 11/2000 | Garcia | 401/122 |

FOREIGN PATENT DOCUMENTS

| | | |
|---|---|---|
| FR | 2 733 673 | 11/1996 |
| JP | 9117322 | 5/1997 |
| JP | 2000253926 | 9/2000 |

* cited by examiner

*Primary Examiner*—John J. Wilson
*Assistant Examiner*—Robyn Kieu Doan
(74) *Attorney, Agent, or Firm*—Martin W. Haerter

(57) ABSTRACT

A cosmetic package has a pouch container insert in an outer shell. The pouch container insert includes all of the elements required to make the cosmetic applicator device functional, i.e., a pouch container defining a product storage chamber, a neck member with a passage to the storage chamber, a cap on the neck member to close the passage and an applicator wand extending from the cap through the passage into the storage chamber. In addition, the neck member includes a flange adapted to connect the pouch container to the package outer shell. The flange has outwardly projecting teeth that engage the outer shell to prevent rotation of the insert with respect to the outer shell. The flange may be modified to adapt it to different outer shells. Thus, the insert is adaptable to outer shells having a variety of different shapes and materials. Because the insert includes all of the essential elements of a cosmetic package, it can be manufactured, filled and sealed apart from the outer shell, and subsequently assembled with any one of a variety of outer shells. In addition, the insert may be provided with an elastic annular ring, preferably in the form of an upwardly directed skirt mounted about the wand and positioned at a location along a length of the wand corresponding to a point between first end and the second end of the neck when the cap is engaged on the second end. The ring is sized and biased with respect to the passage such that compression in the chamber is released as the ring is pushed in the passage toward the chamber and a vacuum is generated in the chamber as the ring is withdrawn in the passage away from the chamber. This vacuum causes the pouch container to collapse a predetermined amount each time the wand is withdrawn from the passage.

35 Claims, 8 Drawing Sheets

POUCH CONTAINER INSERT FOR A COSMETIC PACKAGE AND PACKAGE MADE WITH THE SAME

BACKGROUND OF THE INVENTION

1. Field of the Invention

The present invention relates to containers for holding cosmetics. More particularly, the invention relates to a pouch-like container assembly for insertion into an outer shell of a cosmetic package.

2. Description of the Prior Art

Packaging arrangements for cosmetics, such as, for example, mascara, are often limited by design constraints that determine the shape of the product container and/or the material from which it is made. For example, in order for mascara product to be efficiently transferred onto an applicator inserted in the container, it is generally accepted that the dimensions and cross-sectional shape of the storage chamber should approximate those of the relatively long, cylindrical applicator typically found in mascara packages. For this reason, mascara containers generally have a relatively long cylindrical storage chamber. To avoid the use of excess packaging material, the external shape of the container generally closely approximates the shape and dimensions of the storage chamber. Also, the material from which a cosmetic container is made must generally be selected from one of a limited number of materials that are compatible with cosmetic products, e.g., glass, PE, PP, HDPE, POM, etc. The material should form a barrier that is impervious to escape of the product as well as impervious to contamination from external sources. However, packages having dimensions and made from materials most suitable from a functional and technical standpoint may not be as attractive or as appealing as packages having dimensions and made from materials that are functionally and technically less suitable.

This is particularly true in the cosmetics field, where the appearance and appeal of a package is often as important as the contents of the package. For example, in order to generate renewed consumer interest in a product, it is often desirable to change the appearance of the package by for example changing the shape or other esthetic qualities of the package, e.g., the material from which it is made. As a more specific example, it would be desirable to make a mascara package that has a unique shape, e.g., a pear shape. This is presently less practical because, if the shape of the product storage chamber approximates the external shape of the package, a significant quantity of product in the pear-shaped package would be inaccessible to the applicator brush because it would be too distant from the brush structure. Alternatively, if the shape of the storage chamber differs significantly from the external shape of the package, e.g., a cylindrical storage chamber in a pear-shaped package, substantial additional material would be required in the manufacture of the package to establish or to fill the void between the two shapes. While mascara packages are set forth herein as examples, the principles can be applied to the packages for other cosmetic products, including those that have design constraints less demanding than mascara packages.

U.S. Pat. No. 5,054,946 to Morel discloses an applicator device for cosmetics including an envelope that may have a non-circular cross-section which houses a container with a circular cross-section. The threaded neck and wiper of the device are formed as part of the envelope structure. Thus the envelope must be formed from materials suitable for making a threaded neck and a wiper, e.g., plastic or rubber. Accordingly, the materials from which the envelope can be made are substantially limited. Furthermore, the relatively complex structure of the combined envelope and container would likely add significantly to the cost of manufacturing, assembling and filling the device.

U.S. Pat. No. 5,862,818 to Marinelli discloses a disposable multi-sampler and fitment. The sampler comprises a paquette made of a multi-layer film with the fitment sealing an open end of the paquette. The arrangement appears to be well suited for its intended use, i.e., limited use as a disposable sampler. However, the exposed multi-layer film of the paquette appears to be susceptible to puncture or other damage in an environment in which a cosmetic package typically finds use, e.g., a vanity or a purse where associated grooming tools such as combs, scissors, nail files, etc., are found that could puncture the paquette. In such environments, the paquette affords little or no protection to the contents including the portion of the applicator extending below the fitment into the paquette. Also, because the flexible walls of the paquette are substantially exposed, cosmetic may be undesirably dispensed from within if the paquette is inadvertently squeezed after it is opened.

A container with applicator for liquid cosmetics is disclosed in Japanese patent publication 9117322. The Japanese publication discloses a cylindrical container body having a bag within the container body. A coupling with a neck part supports the bag in an opening in the container body. A cap and applicator combination is supported on the neck part such that the applicator extends into the bag. A pressure board is provided in a window in the container body. Make-up material in the bag is said to be made to adhere to the applicator by pushing on the bag with the pressure board. However, this construction appears to be unnecessarily complex.

A container and applicator for a cosmetic product, e.g., mascara, is disclosed in French Patent No. 2733673. The container has a rigid tubular body open at one end, an applicator in an inner space, and a neck formed by an insert with a collar and a wiper. Product is held inside the container in a pouch with a flexible wall that is subject to atmospheric pressure when the applicator is in use. In most of the embodiments depicted in the figures, the pouch appears to be attached directly to the rigid tubular body of the container, or sandwiched between the rigid tubular body and the neck insert. This type of construction could potentially limit the type, shape and material of a tubular body that could support the pouch and insert.

Accordingly, there is a need for a cosmetic package that can be made simply and cost effectively in a variety of external shapes and from a variety of materials, regardless of compatibility with the product stored within. There is further a need for such a package wherein the contents and the applicator stored within the package are adequately protected from contamination and/or damage.

BRIEF SUMMARY OF THE INVENTION

Disclosed is a cosmetic package with a pouch container insert in an outer shell, or a pouch container insert for a cosmetic package that has an outer shell. The pouch container insert includes a pouch container defining a product storage chamber, a neck member with a passage to the storage chamber, a cap on the neck member to close the passage and an applicator wand extending from the cap through the passage into the storage chamber. The pouch container is securely and impermeably attached to at least one pair of radially extending wedges on the neck member. The neck member includes a flange adapted to mount the pouch container to the package outer shell. The neck member also includes a rotational stop means for preventing rotation of the neck member relative to the outer shell. Because the insert includes all of the essential elements of a cosmetic package, it can be manufactured, filled and sealed apart from the outer shell, and subsequently assembled with any one of a variety of outer shells. Assembly with a selected outer shell can be accomplished with no or only minimal modification of the flange or the opening in the shell, e.g., the shape or dimensions of the flange, or the opening in the shell, may be modified to accommodate assembly without otherwise modifying the components of the insert. Furthermore, a secure permanent or removable connection of the insert to the outer shell can be accomplished with a press-fit or snap-fit engagement that avoids the necessity for bonding or welding with adhesives or heat application. The connection may be configured to permit selective engagement and disengagement of the insert with the outer shell to allow a manufacturer, distributor or consumer to change the outer shell as desired.

The neck member has a first end with at least one pair of wedges fixedly attached to and forming an impervious seal with an opening in the pouch container. A second end of the neck member opposite the first end has threads or other engaging means for receiving the cap. The passage from the first end to the second end of the neck member provides access through the neck member to product stored in the storage chamber. An annular flange extending outwardly from the neck member between the first end and the second end is dimensioned and adapted to connect the insert to the outer shell such that the pouch container is positioned within the outer shell.

The cap is cooperatively threaded or otherwise adapted to be received on the second end of the neck member such that the passage can be selectively opened and closed. An applicator wand has a proximal end connected to the cap and a distal end extending from the cap. The wand is dimensioned to be received in the passage and has a sufficient length to position the distal end of the wand within the chamber when the cap approaches the second end of the neck.

The rotational stop means is provided to prevent rotation of the insert relative to the outer shell. This in turn serves to index the cap and exposed portion of the neck member relative to the outer shell. It also prevents the insert from rotating relative to the outer shell when the user fastens the cap to the neck member by way of the threads. Rotation of the insert relative to the outer shell could cause the pouch container to twist and deform within the outer shell. This in turn could effect the volume available for product storage as well as the quantity of product available to the applicator brush and the ease of withdrawing the brush from and returning the brush to the product reservoir. Accordingly, the rotational stop plays an important role in maintaining the functionality of the package.

In addition, the insert may be provided with means for creating a vacuum in the pouch container. The means for creating a vacuum may, for example, take the form of an elastic annular ring, preferably in the form of an upwardly directed skirt, fixedly mounted about the wand and positioned at a location along a length of the wand corresponding to a point between first end and the second end of the neck when the cap is engaged on the second end. The ring has an outer dimension that is the same as or slightly larger than an inner dimension of the passage, and has a cross-sectional shape corresponding to that of the passage. The ring is configured and biased with respect to the passage such that compression in the chamber is released as the ring is pushed in the passage toward the chamber and a vacuum is generated in the chamber as the ring is withdrawn in the passage away from the chamber. This vacuum causes the pouch container to collapse a predetermined amount each time the wand is withdrawn from the passage. Other vacuum means are discussed in greater detail below.

DETAILED DESCRIPTION OF THE INVENTION

The present invention is directed to a pouch container insert for a cosmetic container having an outer shell, the pouch container insert including a pouch container, a neck member with a flange adapted for connecting the insert to the outer shell, a cap and an applicator wand. The invention is also directed to a cosmetic container incorporating the insert.

Figure 1:
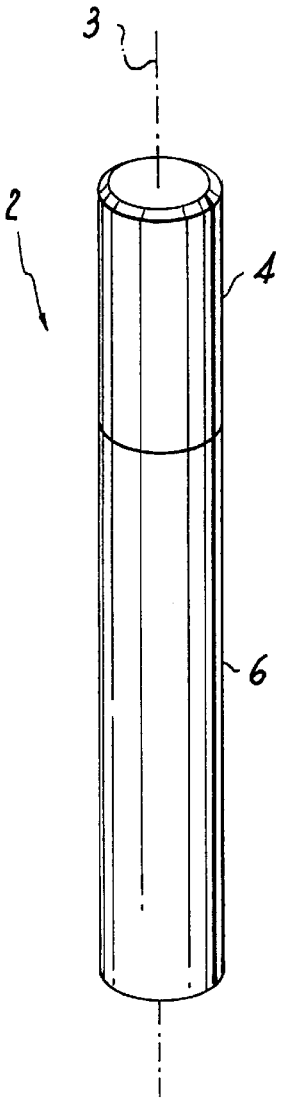
FIG. 1 is an elevation view of the cosmetic package of the present invention with the cap closed.
Figure 2:
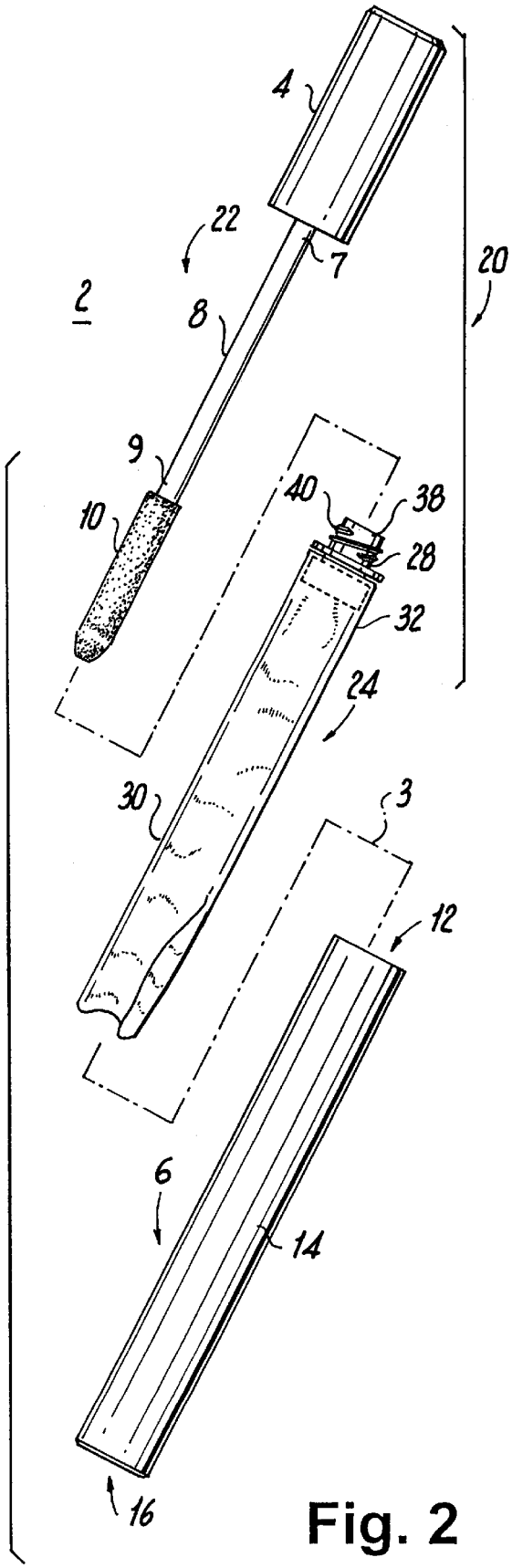
FIG. 2 is an exploded view of the package.
Figure 3:
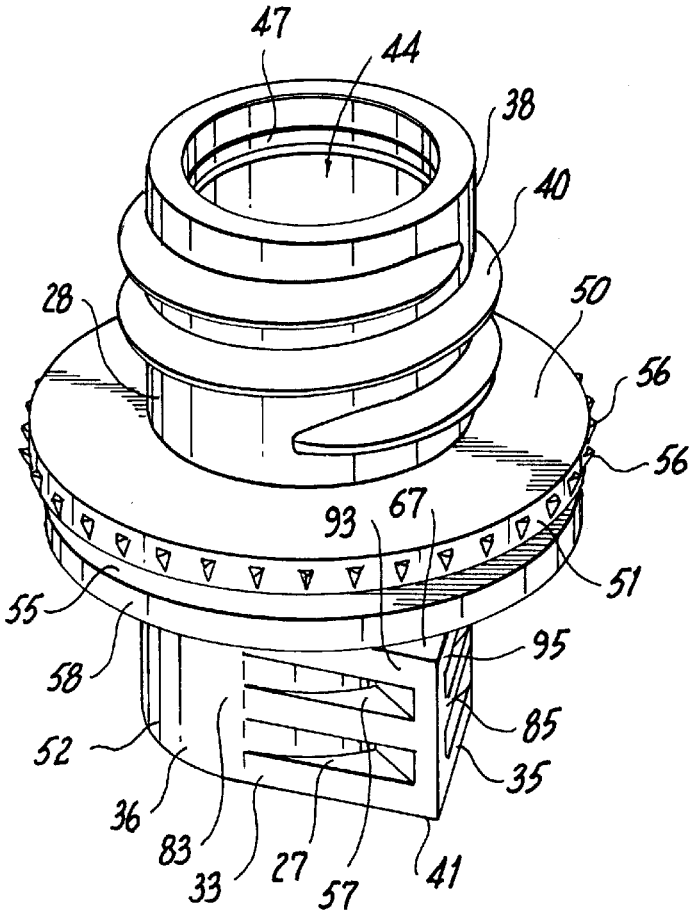
FIG. 3 is a top, front perspective view of the neck member of the present invention.
Figure 4:
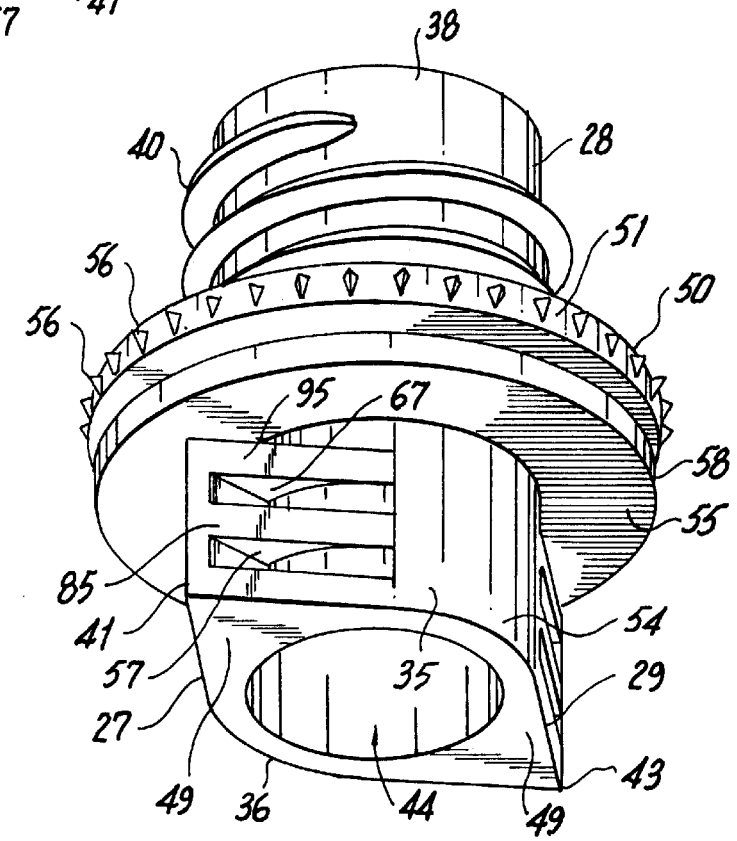
FIG. 4 is a bottom, front perspective view of the neck member.
Figure 5:
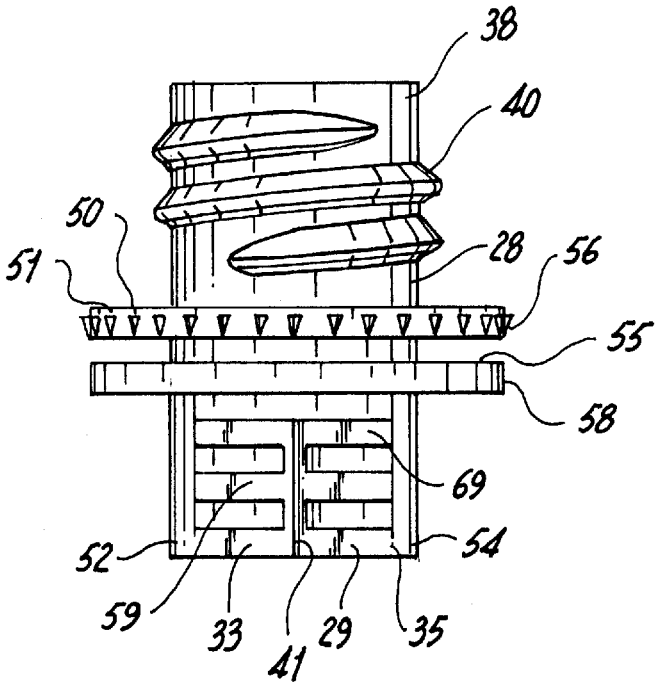
FIG. 5 is a front elevation view of the neck member.

Referring now to FIG. 1, a cosmetic package 2 according to the invention is shown with a cap 4 and a lower body in the form of an outer shell 6 aligned along a longitudinal axis 3. FIG. 2 shows the package 2 in an exploded view. The package 2 includes an insert assembly 20, a lower portion of which is adapted to be enclosed in the outer shell 6. The outer shell 6 has a peripheral wall 14 defining at least one open end 12. An opposite end 16 of outer shell 6 may be open, closed with an integrally molded wall or member, or closed with a plug (not shown). Because the outer shell 6 need not be compatible with the product stored in and dispensed from the insert 20, the outer shell 6 may be made of any suitable material, such as, for example, metal, glass, plastic, paper (e.g., cardboard) or wood which is extruded, formed, molded or machined to have a peripheral wall 14 and an opening 12 suitable for receiving and supporting the insert 20. Advantageously, because almost any structure capable of being worked to receive and support the insert 20 is suitable, the outer shell 6 may comprise relatively exotic materials or structures, such as, for example, a portion of a bamboo stalk. Furthermore, because the product is contained and dispensed from the insert 20, beyond providing sufficient room for receiving and supporting the insert 20, the shape of the outer shell 6 is not dependent on the shape of a particular product storage container or a particular applicator. Thus, the outer shell may take on a variety of shapes, e.g., pear shaped, hourglass shaped, square, round, etc., which previously had been considered unsuitable and/or uneconomical.

The insert 20 includes an applicator portion, shown generally at 22, and a container portion, shown generally at 24. The applicator portion 22 includes an applicator wand 8 with a proximal end 7 attached to the cap 4, and an applicator 10 supported on a distal end 9. The applicator 10 is shown here in schematic form for illustrative purposes. It will be understood that the applicator may be, for example, a brush, a comb, a sponge or fibrous material, a flocked material, or any other structure or arrangement suitable for carrying a supply of cosmetic from a product storage chamber and applying it to the skin, nails, hair (e.g., eyelashes), etc.

Figure 7:
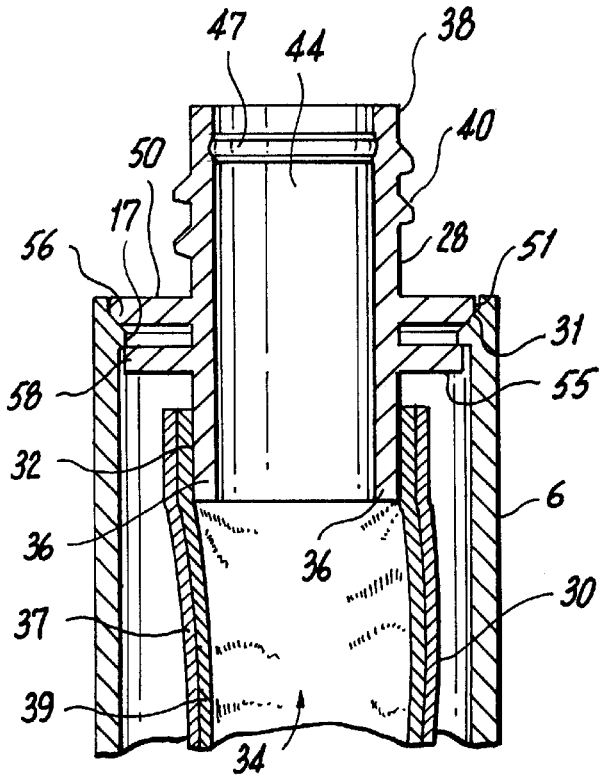
FIG. 7 is a sectional view of the neck member taken along line 7—7 in FIG. 6 with the neck member installed in an outer shell and a top portion of the pouch container attached.
Figure 8:
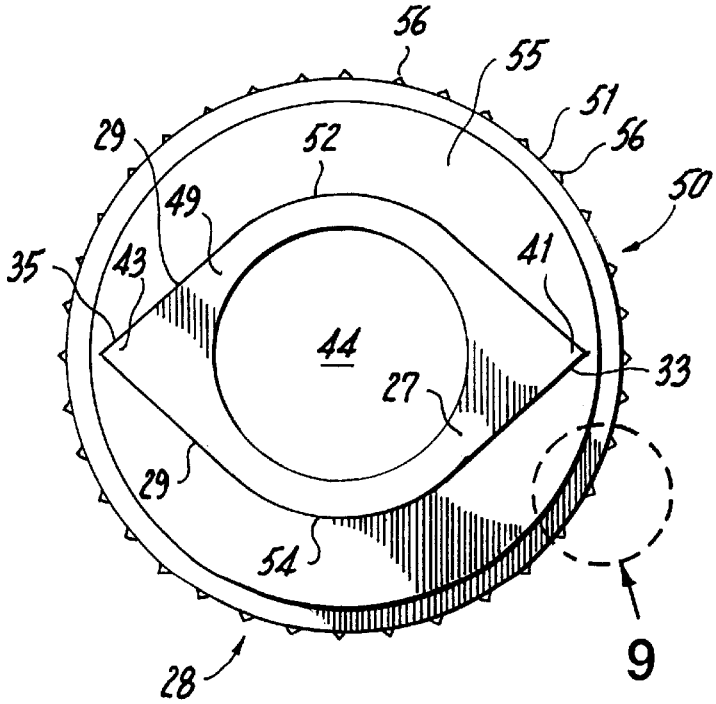
FIG. 8 is a bottom plan view of the neck member shown in FIGS. 3–6.
Figure 9:
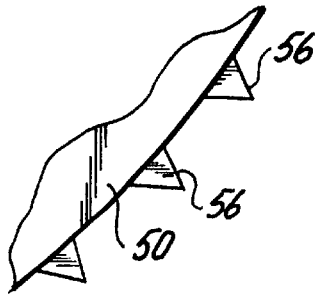
FIG. 9 is a partial detail view taken from FIG. 8 showing the tooth-like projections.

The container portion 24 of the insert 20 includes a pouch container 30 and a neck member 28. The pouch container 30 defines a product storage chamber 34 (see FIGS. 7, 10 and 11) and has an opening 32 at one end. The pouch container 30 is made from a sheet-like flexible material, preferably a multi-layer laminate, such as, for example, an aluminum outer layer 37 and a plastic inner layer 39 (FIG. 7). It will be understood that the outer layer 37 is the side of the sheet-like material furthest from the product storage chamber 34 and the inner layer 39 is the side of the sheet-like material lining the product storage chamber 34. The plastic inner layer is preferably PE (polyethylene). Although shown for illustrative purposes as a two layer laminate, it will be understood that the sheet-like material may be a single layer, or a multi-layer laminate having more than two layers. In any case, the material facing or lining the storage chamber 34 is selected to be both compatible with the product to be stored within the chamber and capable of being imperviously bonded or welded to the neck member 28.

The pouch container 30 is essentially made by forming the sheet-like material into a pouch or bag-like structure with the opening 32 at one end. The pouch container 30 may be made, for example, from two sheets of the material, each sheet either a single layer or multi-layer material. The two sheets are sealed on at least three edges, leaving an opening at one end 32. Alternatively, one sheet of material may be folded along one edge and sealed on at least two other edges to form a pouch with one open end. As another alternative, the pouch or bag structure may be formed from a tubular sheet-like stock, e.g., made by extrusion. The tubular stock is cut into sections and one end is sealed to form a pouch with one open end. Each of the foregoing methods lends itself well to high speed, highly automated formation processes, as well as processes such as a "form/fill/seal" processes wherein the pouch container 30 is formed, bonded or welded to the neck member 28, filled with product, and sealed with an applicator 10, wand 8 and cap 4 in one cooperative production process.

The preferred multi-layer laminate for forming the container pouch is a thin outer layer 37 of aluminum (about 12 microns) and a thin inner layer 39 of PE (polyethylene). Aluminum is preferred as the material for the outer layer 37 because it provides an excellent barrier to oxygen. Oxygen is known to contaminate and/or deteriorate certain cosmetic products, e.g., mascara. The PE inner layer 39 permits a strong plastic to plastic weld or bond, thus facilitating the secure, impervious attachment of the pouch container 30 to the neck member 28. The PE inner layer 39 also provides the necessary material compatibility with the cosmetic product to be stored within the pouch container.

Ideally, the pouch container 30 is made on automated process machinery, and assembled with the other components of the insert 20 on the same machinery. The neck member 28, cap 4, wand 8 and applicator 10 may be separately formed, and fed into the automated process machinery for assembly with the pouch container 30. Once assembled, the insert 20 may be filled with product and sealed in the same process machinery, e.g., "form/fill/seal" process machinery.

Preferably, the neck member 28 is made from a HDPE (high density polyethylene) although other moldable plastic materials may also be suitable, e.g., PP (polypropylene), POM (acetal), etc. The neck member 28 is preferably made by injection molding. As best shown in FIGS. 3–7, the neck member 28 has a first end 36 and a second end 38 opposite the first end. As illustrated in FIG. 7, the first end 36 is fixedly attached to the opening 32 of the pouch container 30 such that an impervious seal is formed between the inner layer 37 of the pouch container 30 and an outwardly directed surface or surfaces of the neck member 28. The pouch container 30 is preferably attached to the neck member 28 by welding, e.g., ultrasonic, induction, etc. Other forms of bonding, welding, adhering or mechanical fastening (e.g., a clamp or ferrule arrangement) are also contemplated for connecting the pouch container to the neck member. The assembly of the insert 20, including bonding or welding of the pouch container 30 and neck member 28 and assembly of the cap 4, wand 8 and applicator 10, may be conducted manually, but preferably all or at least some assembly steps will be automated. Similarly, the completion of a package 2, i.e., positioning and mounting of the insert 20 in an outer shell 6, may be conducted manually, e.g., for exotic shells such as bamboo, or automatically, e.g., for more typical shells such as plastic, metal or glass. The cosmetic product, e.g., mascara, may be filled in the storage chamber 34 during or subsequent to assembly of the neck member 28 and the pouch container 30, or before, during or subsequent to the assembly of the insert 20 and the outer shell 6.

To facilitate the secure attachment of the pouch container 30 on the neck member 28, the first end 36 of the neck member is provided with at least one pair of horizontal wedges 27, 29 each extending radially from an opposite side of the first end 36. Each wedge 27, 29 is attached to the first end 36 by way of a base 49 that is substantially as broad as the width of the first end. Preferably, the base 49 is sufficiently broad to form a smooth transition with the structure of the first end 36. Each wedge 27, 29 tapers from the broad base 49 to a distal edge 41, 43, respectively, where the vertical sides of each wedge intersect to form an acute angle. Thus, the wedges 27, 29, together with intervening portions 52, 54 of the first end 36 define opposite outwardly directed semi-elliptical bonding surfaces 33, 35 extending between distal edges 41 and 43.

Figure 6:
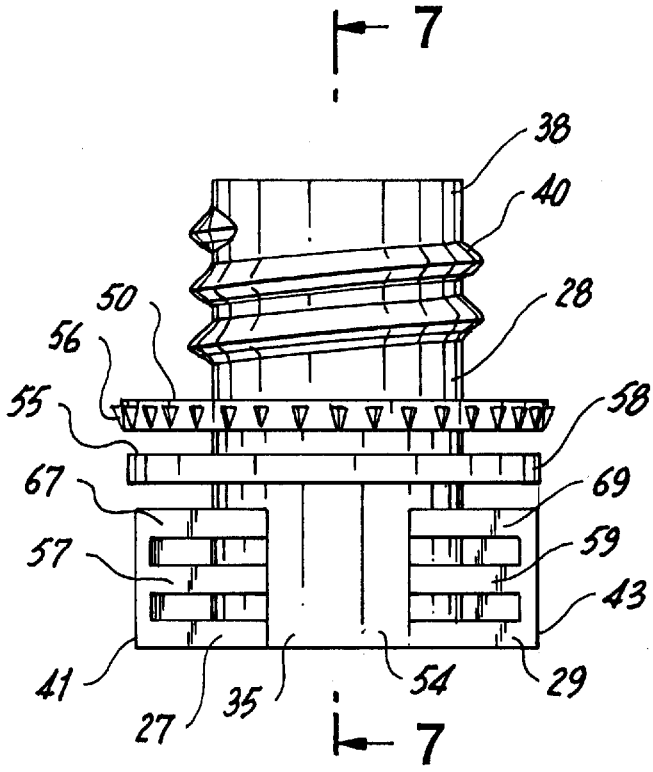
FIG. 6 is a side elevation view of the neck member.

In the preferred embodiment, the neck member has three pairs of opposite wedges, 27, 29, 57, 59, and 67, 69, respectively, (as best illustrated in FIG. 6). As described above with respect to wedges 27 and 29, each pair of wedges 57, 59 and 67, 69, together with corresponding intervening portions of the first end 36, defines opposite outwardly directed semi-elliptical bonding surfaces. Wedges 57 and 59, together with corresponding intervening portions of the first end 36, define bonding surfaces 83 and 85. Wedges 67 and 69, together with corresponding intervening portions of the first end 36, define bonding surfaces 93 and 95.

The opening 32 of the pouch container 30 is fixedly attached to and forms an impervious seal with at least one of the pairs of semi-elliptical bonding surfaces 33 and 35, 83 and 85, or 93 and 95, and preferably with all three pairs of bonding surfaces. In addition to attaching to the bonding surfaces, portions of the opening of the pouch container may also attach to corresponding portions of the first end 36 adjacent to the bonding surfaces, or with structure that bridges the space between adjacent wedges, e.g., portions of the edges 41, 43 that connect adjacent wedges. Because the bonding surfaces 33, 35, 83, 85, 93 and 95 are semi-elliptical, and because they intersect at an acute angle at edges 41 and 43 respectively, the material forming the opening of the pouch container 30 may be bonded about the first end with no need to conform to sharp angles, etc. In other words, the material of the pouch is able to transition smoothly about both sides of the first end 36 of the neck member and meet beyond the acute angles of the wedges. The smooth transition of the laminate material of the pouch about the bonding surfaces permits secure, leak-proof bonding or welding of the laminate material to the first end 36 of the neck member 28.

A passage 44 from the first end 36 to the second end 38 of the neck member 28 provides access through the neck member 28 to the product storage chamber 34. The second end 38 of the neck member 28 is provided with engaging means, e.g., threads 40, for receiving a closure member, i.e., the cap 4. The threads may be the same as those typically found on known mascara containers, e.g., 10 mm or 13 mm., or another suitable size. The cap 4 is provided with corresponding cooperative threads 42 on the inside (see FIGS. 10–11). Thus, the cap 4 and the second end 38 are cooperatively adapted to selectively open and close the passage 44 by known engaging cooperative means such as, for example, threads, bayonet mount, lug and detent, snap-fit, friction-fit, etc.

Figure 10:
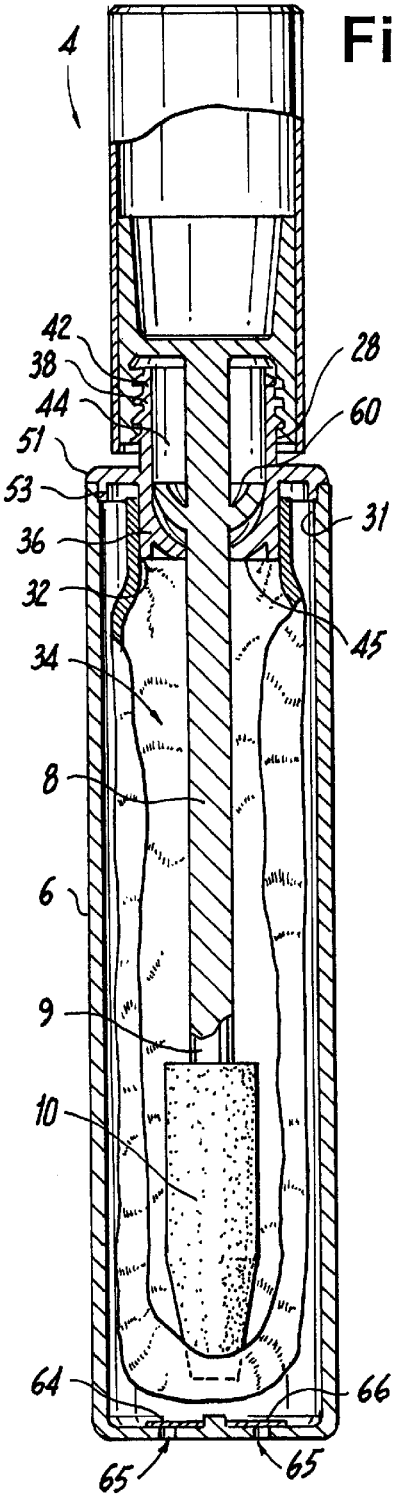
FIG. 10 is a sectional view of an alternative embodiment of the invention wherein the cap closes the passage and the wand is fully inserted, the neck member has only a first flange, a wiper is integrally molded to the neck member, and the outer shell has a check valve.
Figure 11:
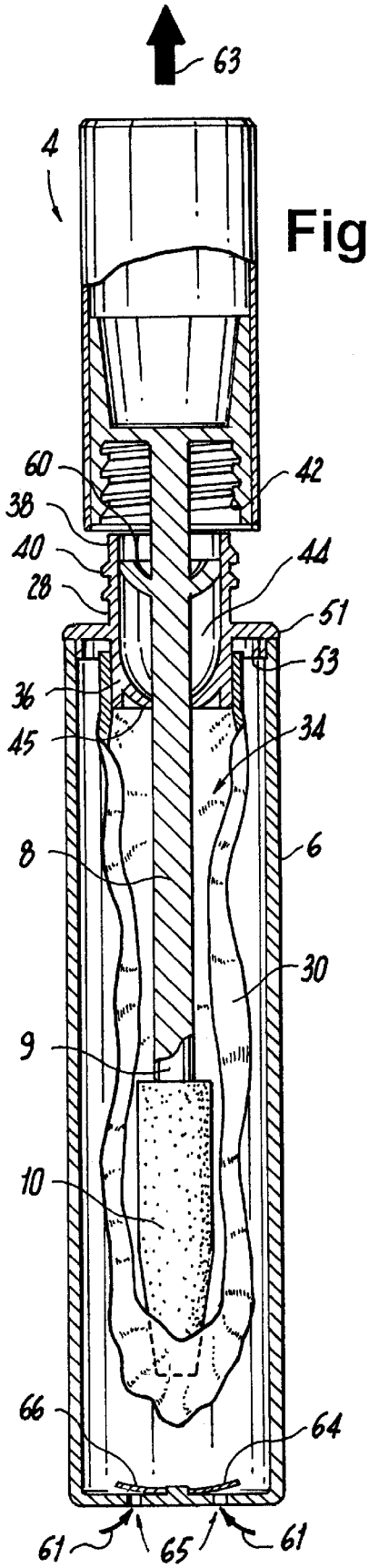
FIG. 11 is a sectional view of the embodiment shown in FIG. 11 showing the cap off and the wand partially withdrawn.

An annular first flange 50 extends outwardly from the neck member 28 between the first end 36 and the second end 38. The first flange 50 is dimensioned and adapted to be connected to the at least one open end 12 of the outer shell 6 such that the pouch container 30 attached to the first end 36 of the neck member 28 is positioned within the peripheral wall 14 of the outer shell 6. Preferably an outwardly directed surface 51 of the first flange frictionally engages an inwardly directed surface 31 of the outer shell 6. In the embodiments shown in FIGS. 1–9 and 12, the outwardly directed surface 51 is provided on the peripheral edge of the flange 50. As shown in FIGS. 10–11, the outwardly directed surface 51 may be provided on, for example, a downwardly depending ridge 53, or other suitable structure. This frictional engagement of the outwardly directed surface 51 of the flange 50 will for many applications be sufficient to securely fasten the insert 20 in the outer shell 6.

To prevent undesired rotation about the longitudinal axis 3 of the insert 20 relative to the outer shell 6, the neck member 28 is provided with rotational stop means, e.g., teeth 56. Without rotational stop means, undesired axial rotation of the insert 20 relative to the outer shell 6 may occur, for example, during assembly of the insert 20 with the outer shell 6. Undesired axial rotation of the insert 20 relative to the outer shell 6 may also occur, for example, during repeated use of the package 2 as the cap 4 is engaged or disengaged from the second end 38 of the neck member 28. Undesired axial rotation of the insert 20 relative to the outer shell 6 may result in twisting or deformation of the pouch container 30 within the outer shell 6. Twisting or deformation of the pouch container 30 within the outer shell 6 may in turn interfere with withdrawal and insertion of the applicator and loading of product onto the applicator. Twisting or deformation of the pouch container may also significantly reduce the product capacity of the pouch container 30. If severe enough, twisting or deformation of the pouch container 30 within the outer shell 6 may also cause the pouch container to rupture or separate from the neck member 28. Accordingly, it is desirable to minimize or eliminate undesired rotation of the insert 20 relative to the outer shell 6.

In its simplest form, the rotational stop means may comprise providing the flange 50 with a non-circular shape in plan view, e.g., a square, an oval, etc., and providing the opening 12 in the outer shell 6 with substantially the identical shape. Alternatively, the perimeter of flange 50 can be provided with a projection or a recess keyed to a complementary recess or projection in the perimeter of opening 12. In other words, the flange 50 is provided with a shape indexed to a complementarily shaped opening 12 in the outer shell 6.

In another alternative (not shown), the rotational stop means may comprise a wall with a groove or other structure projecting from the peripheral wall 14 of the outer shell 6 into the cavity 34 to engage the wedges 27, 29 of the neck member 28 sufficiently to prevent undesired rotation. This alternative is less desirable because structures projecting into the cavity defined by the outer shell 6 could interfere with insertion of the pouch container into the outer shell 6 during assembly of the package 2, and could reduce the capacity of the package 2.

In the embodiment shown in FIGS. 3–7 the rotational stop means takes the form of one or more tooth-like projections 56 on the outwardly directed surface 51 of the first flange 50. It will be understood that the tooth-like projections are merely exemplary, and that other shapes and types of rotation stopping projections or clearances are contemplated. As noted, the rotational stop means could be provided in the form of recesses (not shown) in the same surface 51 that engage complementary projections from the outer shell. The projections 56 also enhance the ability of the surface 51 to frictionally engage the outer shell 6. Additionally, for a more permanent connection, the surface 51 of the flange may be bonded or welded to the outer shell 6 by adhesives or by heat or friction welding techniques suitable for use with the materials of the first flange 50 and the outer shell 6.

Preferably, the neck member 28 includes an annular second flange 55 extending outwardly from the neck member 28 between the first end 36 and the second end 38 (see FIGS. 3–7 and 12). A peripheral edge 58 of the second flange 55 is spaced apart from and positioned below the first flange 50. The second flange 55 is dimensioned to fit closely within the peripheral wall 14 of the outer shell 6, but may or may not contact the peripheral wall in frictional engagement (compare for example, FIGS. 7 and 12). The second flange 55 is optionally provided for at least two reasons. First, the second flange 55 facilitates the alignment of the neck member 28 in the open end 12 of outer shell 6 during assembly and helps to maintain the alignment after assembly. Second, an inwardly projecting ridge 17 (FIG. 7), or a similar reduced diameter portion, may be provided on the inner surface of the opening 12. The ridge 17 or reduced diameter portion is adapted to be received in snap-fit engagement between the first flange 50 and the second flange 55 to more securely fasten the neck member 28 to the outer shell 6. The peripheral edge 58 of the second flange 55 may be slightly beveled to allow it to pass over the ridge 17 on entry of the insert 20 into the outer shell 6. Once the insert 20 is in the outer shell 6, the ridge 17 provides a pre-determined resistance to withdrawal of the second flange 55 from the outer shell 6. The ridge 17 or reduced diameter portion may be annularly continuous or segmented.

To assure that a pre-determined amount of cosmetic remains on the applicator 10 when it is withdrawn from the container 30, a wiper 45 (see FIGS. 10–11) in coaxial alignment with the passage 44 may be provided in the insert 20. The wiper 45 may be integrally molded as part of the neck member 28 as shown in FIGS. 10–11. Alternatively, as is well known in the art, the wiper may be provided as a separate member (not shown) that snaps into an annular groove 47 (FIGS. 3, 7 and 12) in the passage 44.

To facilitate the transfer of cosmetic product from the product storage chamber 34 onto the applicator 10, the insert 20 is provided with vacuum means configured to draw air from the product storage chamber 34 to collapse the pouch container a predetermined amount each time the wand 8 is withdrawn from the passage 44. In its simplest form, the vacuum means may consist of the wiper 45 (see FIGS. 10 and 11) being cooperatively dimensioned and inwardly biased to closely fit the applicator wand 8 such that a vacuum is created on withdrawal of the applicator wand 8 from the package 2. Conversely, the wiper 45 and wand 8 are further configured and biased to release excess pressure from the package 2 that might occur upon insertion of the wand 8 into the package.

Alternatively, the vacuum means may consist, for example, of an elastic annular ring 60 (see FIGS. 10–11) preferably in the form of an upwardly directed skirt. The ring 60 may be a separate member fixedly mounted about the wand 8, or, as shown in FIGS. 10–11, an integrally molded component of the wand 8. The ring 60 is located along a length of the wand 8 at a position corresponding to a point between the first end 36 and the second end 38 of the neck member 28 when the cap 4 is close to or engaged with the second end 38. In other words, when the wand 8 is in the passage 44 and the cap 4 is close to or secured on the package 2, the ring 60 is positioned in the passage 44 proximal to the first end 36. The ring 60 has sectional shape and an outer dimension that is the same as or slightly larger than the sectional shape and inner dimension of the passage 44. Preferably, the passage 44 has a circular cross-section. The ring 60 is configured and biased with respect to the passage 44 such that compression in the chamber 34 is released past the ring 60 as the ring 60 is pushed in the passage 44 toward the chamber 34. Conversely, a vacuum is generated in the chamber 34 as the ring 60 is withdrawn in the passage 44 away from the chamber 34 (in the direction of arrow 63 in FIG. 11). The vacuum causes the pouch container 30 to collapse a predetermined amount with each withdrawal of the applicator wand 8 (note the difference in volume between the pouch container 30 in FIG. 10 and FIG. 11). The predetermined amount of collapse of the container is selected to approximate the volume of product withdrawn from the chamber 34 by the applicator 10. Thus, with each withdrawal of the ring 60 the pouch container 30 collapses further, which in turn pushes the remaining product in the pouch container toward the applicator 10. In this way, nearly all of the product in the storage chamber can be dispensed, with little or no waste in the form of product remaining in the package that is inaccessible to the applicator.

Figure 13:
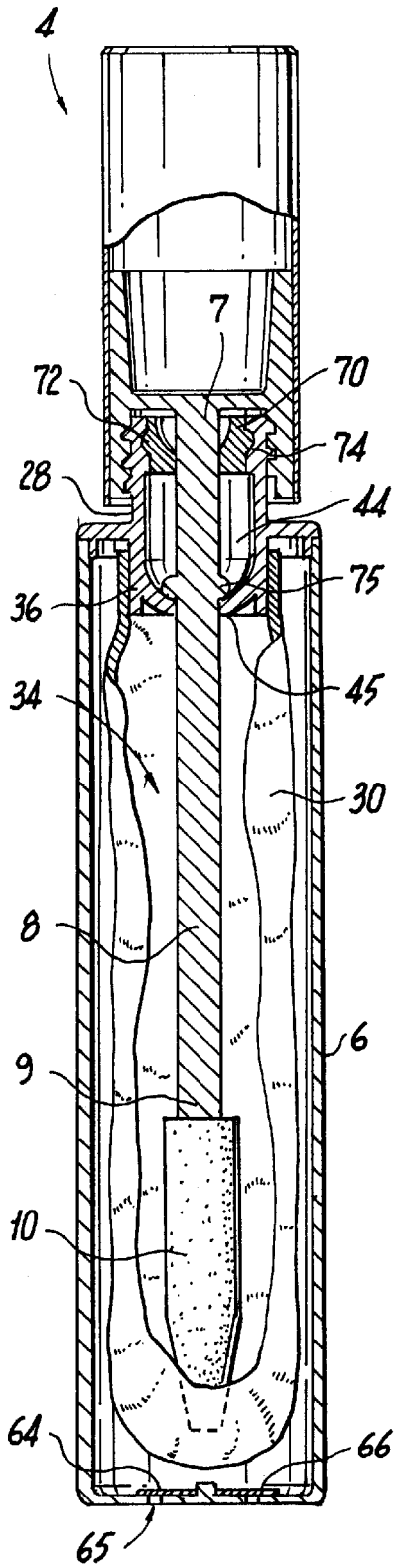
FIG. 13 is a sectional view of an alternative embodiment of the invention wherein the vacuum means is an annular ring that is slidable on the wand.
Figure 14:
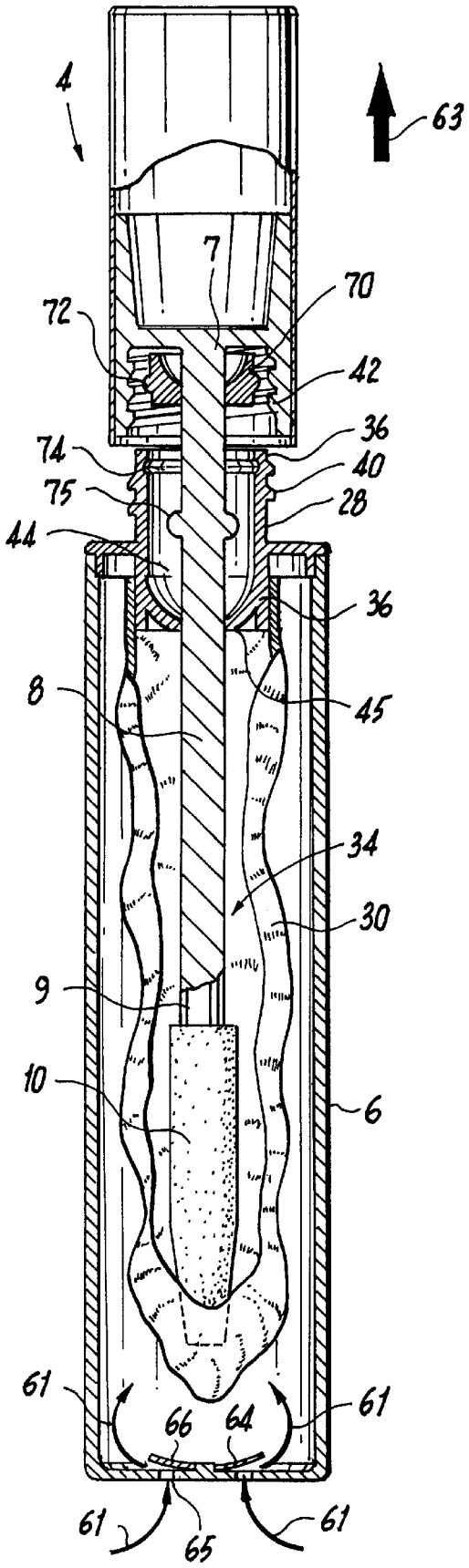
FIG. 14 is a sectional view of the embodiment of FIG. 13 showing the cap off.

In another alternative embodiment shown in FIGS. 13–16, the vacuum means consists of an elastic ring 70 slidably mounted about the wand 8. As shown in FIGS. 13–14, when the cap 4 is in the closed position, an outwardly directed annular ridge 72 on the ring 70 engages an annular groove 74 on inwardly directed surface of the passage 44 in neck member 28. This engagement initially retains the ring 70 in the top of the passage 44, preventing the ring 70 from moving out of the passage 44 as the cap 4 is unfastened for removal (in the direction of arrow 63). However, as the wand is withdrawn through the passage 44, a ferrule 75 on wand 8 pushes against the bottom of ring 70 such that ridge 72 disengages from groove 74, and the ring is free to move out of passage 44. The ring is also free to move along the wand 8 between the ferrule 75 and the proximal end 7 of the wand. When the wand is returned to the passage 44 (i.e., in a direction opposite that of arrow 63), the proximal end 7 of wand 8 pushes against the top of ring 70 such that the ridge 72 is pushed back into engagement with groove 74. This controlled movement of the ring 70 with respect to the wand 8 and the passage 44 acts to meter the amount of vacuum applied to the chamber 34.

Figure 15:
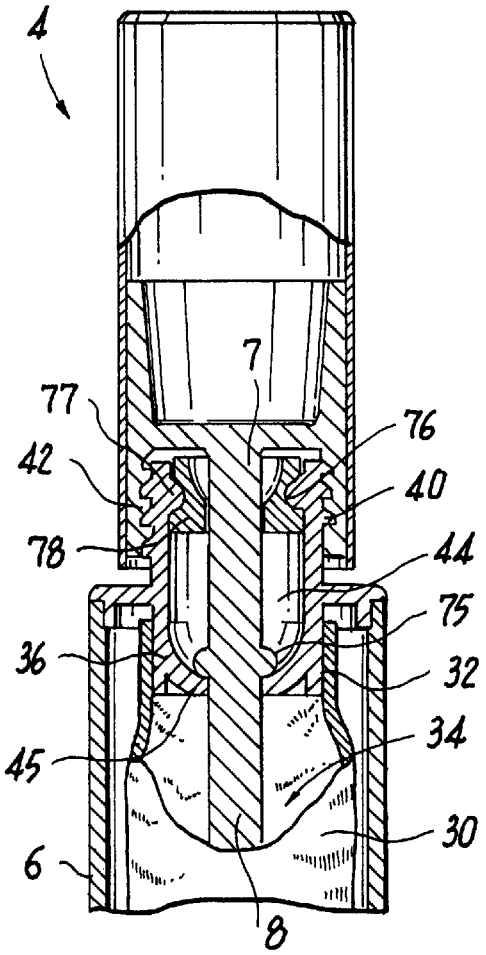
FIG. 15 is a sectional view of an alternative embodiment of the invention as shown in FIG. 13.
Figure 16:
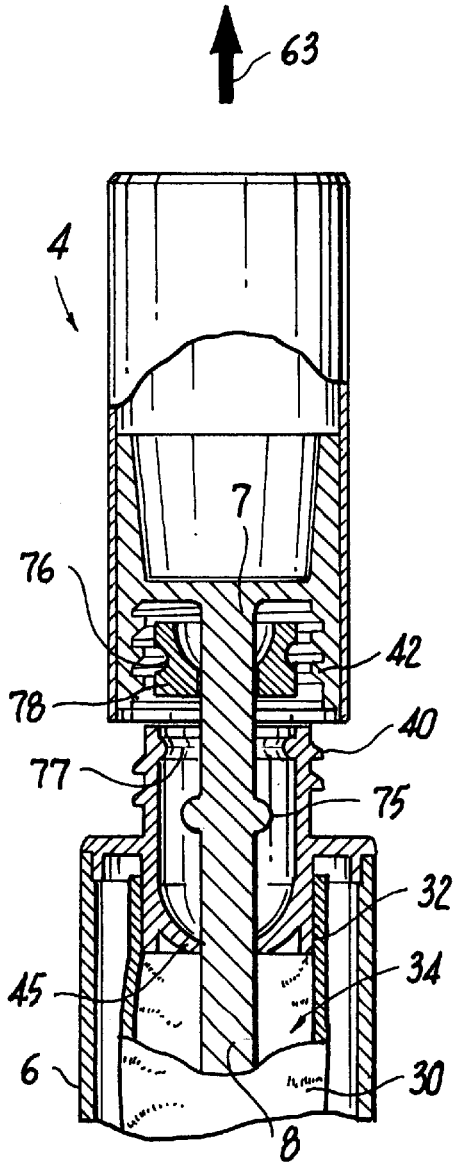
FIG. 16 is a sectional view of the embodiment of FIG. 15 showing the cap off.

In FIGS. 15–16, the arrangement is similar to that shown in FIGS. 13–14, i.e., the vacuum means consists of an elastic ring 78 slidably mounted about the wand 8. However, in the embodiment shown in FIGS. 15–16, when the cap 4 is in the closed position, an outwardly directed annular groove 76 on the ring 78 engages an annular ridge 77 on the inwardly directed surface of the passage 44 in neck member 28. This engagement initially retains the ring 78 in the top of the passage 44, preventing the ring 78 from moving out of the passage 44 as the cap 4 is unfastened for removal (in the direction of arrow 63). However, as the wand is withdrawn through the passage 44, the ferrule 75 on wand 8 pushes against the bottom of ring 78 such that ridge 77 disengages from groove 76, and the ring is free to move out of passage 44. The ring is also free to move along the wand 8 between the ferrule 75 and the proximal end 7 of the wand. When the wand is returned to the passage 44 (i.e., in a direction opposite that of arrow 63), the proximal end 7 of the wand 8 pushes against the top of ring 78 such that the ridge 77 engages with groove 76 on ring 78. This controlled movement of the ring 78 with respect to the wand 8 and the passage 44 acts to meter the amount of vacuum applied to the chamber 34.

The ability of each of the foregoing embodiments of the vacuum means to collapse the pouch container can be further enhanced by providing a vent 65 (see FIGS. 10–11), for example, in the flange or in the outer shell, to allow air to enter the outer shell as product is transferred out of the pouch container. In this way the pouch container can freely collapse inwardly as product is withdrawn. The function of the vent 65 can be further enhanced by providing a check valve 64, or other one-way valve, in communication with the vent 65. The check valve 64 prevents the pouch container from re-expanding after the vacuum has withdrawn the pre-determined amount of air volume. The check valve comprises, for example, a membrane or reed 66 fastened such that it can swing to open vent 65 when the wand 8 is withdrawn from the package 2, and is biased or configured to close vent 65 when the wand is inserted into the package 2. The check valve may alternatively comprise a ball valve or diaphragm valve similarly biased. In response to the container pouch 30 collapsing within the outer shell 6 as product is withdrawn, the check valve 64 opens to permit entry of air into the outer shell 6 (see FIG. 11, arrows 61) and is biased to close to prevent escape of air from the outer shell 6 (FIG. 10). This in turn prevents the collapsed pouch container 30 from re-expanding by discouraging air from entering the pouch container 30 through passage 44 as the wand 8 and applicator 10 are returned to the package. In the partially collapsed state, cosmetic product within the storage chamber 34 is pushed closer to the applicator 10 and is thus more readily accessible to load the applicator 10.

Figure 12:
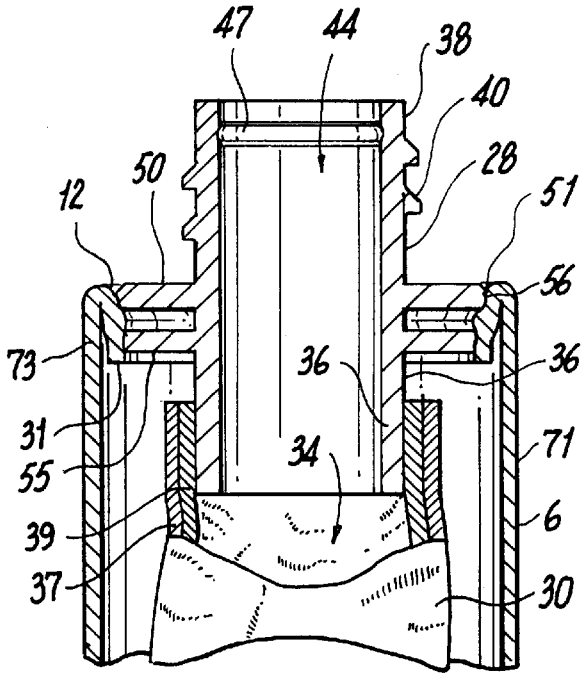
FIG. 12 is a sectional view similar to that of FIG. 7 showing the neck member attached to a different outer shell.

FIG. 12 shows the neck member 28 and pouch container 30 installed in another embodiment of an outer shell, i.e., a cardboard tube 71. The top edge 73 of the tube is rolled over to form a stiffened opening 12 for receiving the neck member 28. The dimensions of the opening 12 are such that the surface 51 of flange 50 is forced into the cardboard, thus securely fastening the neck member 28 and pouch container 30 to the cardboard tube outer shell. The cardboard tube has the advantage of providing at a relatively low cost a durable outer shell that can be attractively decorated.

Because the insert is self-contained in that it includes all of the elements necessary to store, dispense and apply cosmetic, i.e., a container, a neck (with an optional wiper), a cap and a wand, the insert is readily adaptable to be installed in the open end of any suitable outer shell. This includes outer shells made of plastic, glass, metal or even exotic materials such as bamboo. Thus, a single insert may be suitable for use in a variety of different outer shells. The insert is simple in design, cost effective to manufacture and assemble, may be pre-loaded with product, and is adaptable for a variety of different cosmetic package applications.

While the invention has been described and illustrated as embodied in preferred forms of construction, it will be understood that various modifications may be made in the structure and arrangement of the parts without departing from the spirit and the scope of the invention recited in the following claims.

What is claimed is:

1. An insert for a cosmetic package that has an outer shell with a peripheral wall defining at least one open end, the insert comprising:

a pouch container defining a product storage chamber, the container having an opening;

a neck member having:

a first end having a pair of horizontal wedges extending radially from opposite sides, each wedge attached to the first end by way of a base substantially as broad as a width of the first end, and each wedge tapering from the base to a distal edge defining an acute angle, the wedges and intervening portions of the first end defining opposite outwardly directed bonding surfaces, the opening of the pouch container fixedly attached to and forming an impervious seal with the bonding surfaces;

a second end opposite the first end;

a passage from the first end to the second end of the neck member, the passage providing access through the neck member to the chamber; and an annular first flange extending outwardly from the neck member between the first end and the second end, the first flange dimensioned and adapted to be connected to the at least one open end of the outer shell such that the pouch container is positioned within the peripheral wall;

a cap adapted to selectively open and close the passage by engaging cooperative means on the second end; and an applicator wand with a proximal end connected to the cap and a distal end extending from the cap, the wand dimensioned to be received in the passage and having a sufficient length to position the distal end of the wand within the chamber when the cap is at least proximal to the second end of the neck.

2. The insert of claim 1 wherein each of the pair of bonding surfaces is semi-elliptical.

3. The insert of claim 1 wherein an outwardly directed surface of the first flange is adapted to frictionally engage an inwardly directed surface of the outer shell.

4. The insert of claim 1 further comprising an annular second flange extending outwardly from the neck member between the first end and the first flange, a peripheral edge of the second flange spaced apart from and positioned below the first flange, the second flange dimensioned to fit closely within the peripheral wall of the outer shell.

5. The insert of claim 1 wherein the first flange further comprises rotational stop means for preventing rotation of the insert relative to the outer shell.

6. The insert of claim 5 wherein the rotational stop means comprise at least one tooth-like projection.

7. The insert of claim 1 wherein the pouch container is made from a multi-layer laminate.

8. The insert of claim 7 wherein an outer layer of the laminate is an aluminum foil, and wherein an inner layer of the laminate is PE.

9. The insert of claim 1 wherein the neck member is made from a material selected from PP, HDPE and POM.

10. The insert of claim 1 wherein the first end is fixedly attached to the opening in the pouch container by welding.

11. The insert of claim 1 wherein the passage has a circular cross-section and the insert further comprises:

an elastic annular ring mounted about the wand and positioned at a location along a length of the wand corresponding to a point between the first end and the second end of the neck when the cap is engaged with the second end, the ring having an outer dimension that is the same as or slightly larger than an inner dimension of the passage, the ring configured and biased with respect to the passage such that compression in the chamber is released as the ring is pushed in the passage toward the chamber and a vacuum is generated in the chamber as the ring is withdrawn in the passage away from the chamber, wherein, the pouch container collapses a predetermined amount each time the wand is withdrawn from the passage.

12. The insert of claim 11 wherein the ring is fixedly mounted to the wand.

13. The insert of claim 11 further comprising a ferrule fixedly positioned on the wand between the proximal end and the distal end, wherein the ring is slidably mounted on the wand and is movable on the wand between the ferrule and the proximal end.

14. The insert of claim 13 wherein an outwardly directed surface of the ring is provided with one of an annular ridge and an annular groove, and an inwardly directed surface of the neck member is provided with the other of an annular ridge and an annular groove, the respective ridge and groove engaging sufficiently to initially limit movement of the ring when the wand is withdrawn from the passage.

15. The insert of claim 1 further comprising a wiper in coaxial alignment with the passage.

16. The insert of claim 15 wherein the wiper is integrally formed with the neck member.

17. A cosmetic package comprising:

an outer shell with a peripheral wall defining at least one open end;

a pouch container defining a product storage chamber, the container having an opening;

a neck member having:

a first end having a pair of horizontal wedges extending radially from opposite sides, each wedge attached to the first end by way of a base substantially as broad as a width of the first end, and each wedge tapering from the base to a distal edge defining an acute angle, the wedges and intervening portions of the first end defining opposite outwardly directed bonding surfaces, the opening of the pouch container fixedly attached to and forming an impervious seal with the bonding surfaces;

a second end opposite the first end;

a passage from the first end to the second end of the neck member, the passage providing access through the neck member to the chamber; and an annular first flange extending outwardly from the neck member between the first end and the second end, the first flange connected to the at least one open end of the outer shell such that the pouch container is positioned within the peripheral wall;

a cap adapted to selectively open and close the passage by engaging cooperative means on the second end; and an applicator wand with a proximal end connected to the cap and a distal end extending from the cap, the wand dimensioned to be received in the passage and having a sufficient length to position the distal end of the wand within the chamber when the cap is at least proximal to the second end of the neck.

18. The cosmetic package of claim 17 wherein an outwardly directed surface of the first flange frictionally engages an inwardly directed surface of the outer shell.

19. The cosmetic package of claim 17 further comprising an annular second flange extending outwardly from the neck member between the first end and the first flange, a peripheral edge of the second flange spaced apart from and positioned below the first flange, the second flange dimensioned to fit closely within the peripheral wall of the outer shell.

20. The cosmetic package of claim 17 wherein the first flange further comprises rotational stop means for preventing rotation of the insert relative to the outer shell.

21. The cosmetic package of claim 17 wherein the rotational stop means comprise at least one tooth-like projection.

22. The cosmetic package of claim 17 wherein the pouch container is made from a multi-layer laminate.

23. The cosmetic package of claim 22 wherein an outwardly facing layer of the laminate is an aluminum foil and an inwardly facing layer of the laminate is PE.

24. The cosmetic package of claim 17 wherein the neck member is made from a material selected from PP, HDPE and POM.

25. The cosmetic package of claim 17 wherein the first end is fixedly attached to the opening in the pouch container by welding.

26. The cosmetic package of claim 17 wherein the passage has a circular cross-section and the cosmetic package further comprises:

an elastic annular ring mounted about the wand and positioned at a location along a length of the wand corresponding to a point between the first end and the second end of the neck when the cap is engaged with the second end, the ring having an outer dimension that is the same as or slightly larger than an inner dimension of the passage, the ring configured and biased with respect to the passage such that compression in the chamber is released as the ring is pushed in the passage toward the chamber and a vacuum is generated in the chamber as the ring is withdrawn in the passage away from the chamber, wherein, the pouch container collapses a predetermined amount each time the wand is withdrawn from the passage.

27. The cosmetic package of claim 26 wherein the ring is fixedly mounted to the wand.

28. The cosmetic package of claim 26 further comprising a ferrule fixedly positioned on the wand between the proximal end and the distal end, wherein the ring is slidably mounted on the wand and is movable on the wand between the ferrule and the proximal end.

29. The cosmetic package of claim 28 wherein an outwardly directed surface of the ring is provided with one of an annular ridge and an annular groove, and an inwardly directed surface of the neck member is provided with the other of an annular ridge and an annular groove, the respective ridge and groove engaging sufficiently to initially limit movement of the ring when the wand is withdrawn from the passage.

30. The cosmetic package of claim 17 further comprising a wiper coaxially aligned with the passage.

31. The cosmetic package of claim 30 wherein the wiper is integrally formed with the neck member.

32. The cosmetic package of claim 17 further comprising a vent in one of the outer shell or the neck member.

33. The cosmetic package of claim 32 further comprising a check valve in communication with the vent, the valve configured to permit entry of air into the package and prevent escape of air from the package.

34. The cosmetic package of claim 17 wherein the open end of the outer shell further comprises a reduced diameter portion adapted to be received between the first flange and the second flange.

35. The cosmetic package of claim 17 wherein each of the pair of bonding surfaces is semi-elliptical.

* * * * *